US006037316A

United States Patent [19]

Garner et al.

[11] Patent Number: 6,037,316

[45] **Date of Patent: *Mar. 14, 2000**

[54] WATER SOLUBLE ABRASIVE COMPOSITION CONTAINING BORAX PENTAHYDRATE

[75] Inventors: Denise A. Garner, Hayward; James R. Latham, Livermore; Donald K. Swatling, Oakland; Kelley A. Henderson, Dublin; David G. Cohen, Livermore, all of Calif.

[73] Assignee: The Clorox Company, Oakland, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/718,059

[22] Filed: Sep. 17, 1996

[51] Int. Cl.[7] ..... C11D 1/00; C11D 17/00; C11D 13/00; C11D 3/38

[52] U.S. Cl. ..... 510/238; 510/365; 510/418; 510/424; 510/427; 510/460; 510/465; 510/503; 510/509

[58] Field of Search ..... 510/235, 236, 510/424, 242, 427, 238, 365, 368, 369, 418, 460, 465, 503, 509

[56] References Cited

U.S. PATENT DOCUMENTS

| | | | |
|---|---|---|---|
| 3,281,367 | 10/1966 | Jones et al. | 252/112 |
| 3,530,071 | 9/1970 | Moore | 252/99 |
| 3,583,922 | 6/1971 | McClain et al. | 252/99 |
| 3,607,161 | 9/1971 | Monick | 51/307 |
| 3,882,034 | 5/1975 | Gibbons | 252/99 |
| 3,944,506 | 3/1976 | Hramchenko et al. | 252/526 |
| 3,981,826 | 9/1976 | Munro | 252/526 |
| 4,048,123 | 9/1977 | Hramchenko et al. | 252/545 |
| 4,129,527 | 12/1978 | Clark et al. | 252/547 |
| 4,255,418 | 3/1981 | Bailey | 424/145 |
| 4,530,780 | 7/1985 | Van de Pas et al. | 252/528 |
| 4,614,606 | 9/1986 | Machin et al. | 252/116 |
| 4,618,446 | 10/1986 | Haslop et al. | 252/135 |
| 4,637,892 | 1/1987 | Merryman | 252/139 |
| 4,751,016 | 6/1988 | Tse et al. | 252/174.25 |
| 4,784,788 | 11/1988 | Lancz | 252/114 |
| 4,788,005 | 11/1988 | Castro | 252/539 |
| 5,281,355 | 1/1994 | Tsaur et al. | 252/174.13 |
| 5,665,691 | 9/1997 | France et al. | 510/444 |

FOREIGN PATENT DOCUMENTS

| | | | |
|---|---|---|---|
| 193375 | 9/1986 | European Pat. Off. | C11D 17/00 |
| 91/08282 | 6/1991 | WIPO | C11D 17/00 |

OTHER PUBLICATIONS

Neobor Borax 5 Mol Product Specification B–0110–U (Jul. 26, 1995).

North American Chemical Company V–BOR Refined Pentahydrate Borax Technical Information Bulletin 5500 (Nov. 1994).

*Condensed Chemical Dictionary* 9th Ed.—(1977) p. 119.

*Primary Examiner*—Necholus Ogden
*Attorney, Agent, or Firm*—Joel J. Hayashida

[57] ABSTRACT

The invention provides an improved surface safe, aqueous, liquid hard surface cleaner which contains a nonionic surfactant, or combination of nonionic and anionic surfactants, a water soluble abrasive, namely, borax pentahydrate, in an amount which takes at least a portion of the abrasive out of solution, and water.

15 Claims, 1 Drawing Sheet

WATER SOLUBLE ABRASIVE COMPOSITION CONTAINING BORAX PENTAHYDRATE

BACKGROUND OF THE INVENTION

1. Field of the Invention

The invention relates to an improved surface safe, aqueous, liquid hard surface cleaner comprising a nonionic surfactant, or combination of nonionic and anionic surfactants, a water soluble abrasive, namely, borax pentahydrate, in an amount which takes at least a portion of the abrasive out of solution, and water.

2. Brief Statement of the Related Art

Abrasive cleansers have long been in commercial use. These are typically dry powders incorporating silica sand and a source of hypochlorite. However, while these types of cleaners can effectively clean rough surfaces, such as concrete, their use is contraindicated on shiny or smooth surfaces, such as tiles or composite hard surfaces, such as ceramic, Formica® or Corian®, which can be dulled with use. There have been some successful attempts at mitigating the harsh action of abrasives, represented by the liquid cleansers of Clark et al., U.S. Pat. No. 4,129,527, Tse et al., U.S. Pat. No. 4,751,016, Castro, U.S. Pat. No. 4,788,005, all of which disclose the use of softer abrasives, such as those having a Mohs hardness of less than about 4. Castro, in particular, discloses the use of a discrete amount of unspecified borax as a rheology modifying ingredient in a liquid cleanser.

Somewhat more recently, the use of particulate materials which are partially in solution and partially undissolved, has been attempted as a means of providing abrasive action. WO 91/08282 and EP 0 193 375 disclose the use of preferably sodium bicarbonate, in amounts of up to 45% and in excess thereof, respectively, as such water soluble abrasive. Both references mention the potential use of borax decahydrate, only.

Concentrated liquid detergents are also proposed in which materials which act as electrolytes, including unspecified borates, have also been proposed. These concentrated liquids, also called "structured liquids," however, contain very high amounts of surfactants which must be diluted in usage, thereby obviating any potential abrasive effect. Examples of these include Haslop et al., U.S. Pat. No. 4,618,446, and van de Pas et al., U.S. Pat. No. 4,530,780.

Borax, or, more accurately, disodium tetraborate, has been also used as cleaning agent in cleaners. For example, a carpet cleaning solution incorporating surfactant, sodium borate and an aromatic petroleum solvent was disclosed in Merryman, U.S. Pat. No. 4,637,892.

However, it has not been heretofore disclosed, taught, or suggested, that one can formulate an improved surface safe, aqueous, liquid hard surface cleaner comprising a nonionic surfactant, or combination of nonionic and anionic surfactants, and use, as the water soluble abrasive, borax pentahydrate.

SUMMARY OF THE INVENTION AND OBJECTS

The invention provides an improved surface safe, aqueous, liquid hard surface cleaner comprising:

a) an effective amount of either a nonionic surfactant, or combination of nonionic and anionic surfactants;

b) a water soluble borax pentahydrate, at least a part of which is undissolved, forming an abrasive portion; and c) the remainder, water.

It is therefore an object of this invention to provide an improved surface safe liquid hard surface cleaner.

It is another object of this invention to provide an abrasive, liquid cleaner with optimal rinsability.

It is still another object of this invention to provide an abrasive, liquid cleaner with excellent cleaning performance while not mitigating its surface safety attributes.

It is yet another object of this invention to provide a liquid cleaner whose abrasive action results from an undissolved portion of borax pentahydrate.

It is a further object of this invention to provide an optimal process for manufacturing the inventive liquid cleaners by milling granular borax pentahydrate in situ.

It is also an object of this invention to provide an optimal process for manufacturing the inventive liquid cleaners by providing to the liquid ingredients particulate borax pentahydrate of optimal particle size.

DETAILED DESCRIPTION OF THE INVENTION

Figure 1:
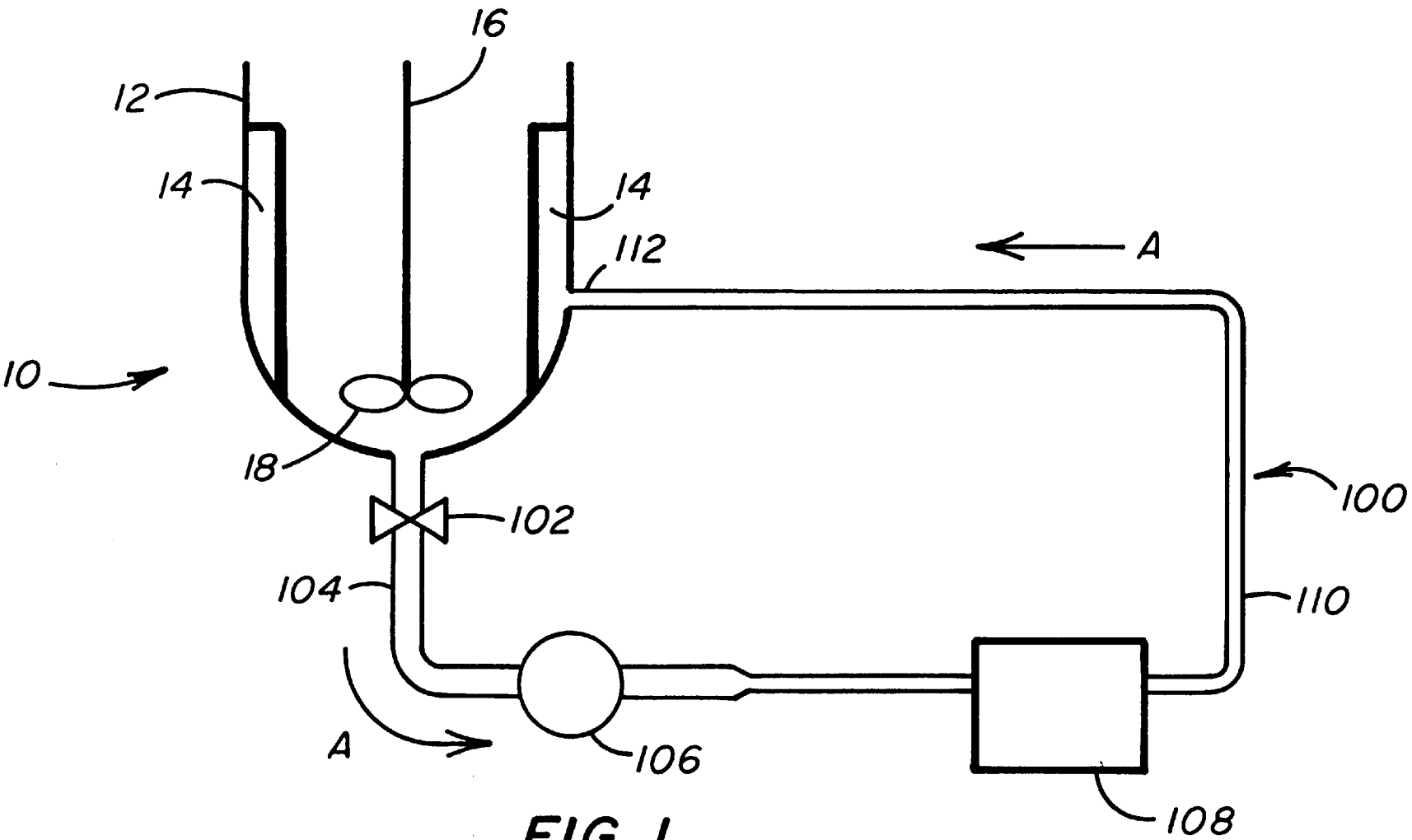
FIG. 1 is a schematic depiction of the novel process of the invention.

The invention provides an improved surface safe, aqueous, liquid hard surface cleaner comprising:

a) an effective amount of either a nonionic surfactant, or combination of nonionic and anionic surfactants;

b) a water soluble borax pentahydrate, at least a part of which is undissolved, forming an abrasive portion; and c) the remainder, water.

In a preferred embodiment, an optimal process for manufacturing the inventive cleaners is provided.

Standard, additional adjuncts in small amounts such as pigments, dye, opacifiers, fragrances, antimicrobial (mildewstat/bacteristat), chelating agents and the like can be included to provide desirable attributes of such adjuncts.

In the application, effective amounts are generally those amounts listed as the ranges or levels of ingredients in the descriptions which follow here to. Unless otherwise stated, amounts listed in percentage ("%'s") are in weight percent of the composition.

1. Surfactants

As mentioned above, the surfactants are either a nonionic surfactant, or a combination of nonionic and anionic surfactant.

a. Nonionic surfactants. Most preferred are the so-called semi-polar nonionic surfactants. These include trialkyl amine oxides, alkylamidoalkylenedialkylamine oxide, and sulfoxides.

The structure of the trialkyl amine oxide is shown below:

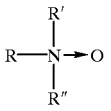

wherein R is $C_{6-24}$ alkyl, and R' and R" are both $C_{1-4}$ alkyl, although R' and R" do not have to be equal. These amine oxides can also be ethoxylated or propoxylated in the R long chain, or hydroxylated in the R', R" groups. The preferred amine oxide is lauryl amine oxide, such as Barlox 12, from Lonza Chemical Company.

The structure of the alkylamidoalkylenedialkylamine oxide is shown below:

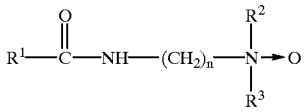

wherein $R^1$ is $C_{5-20}$ alkyl, $R^2$ and $R^3$ are $C_{1-4}$ alkyl

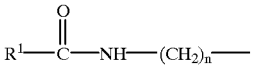

or $—(CH_2)_p—OH$, although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole). The preferred alkylamidoalkylenedialkylamine oxide is Barlox C, from Lonza Chemical Company.

Other nonionic surfactants can be chosen from, among others: Alfonic surfactants, sold by Conoco, such as Alfonic 1412-60, a $C_{12-14}$ ethoxylated alcohol with 7 moles of EO; Neodol surfactants, sold by Shell Chemical Company, such as Neodol 25-7, a $C_{12-15}$ ethoxylated alcohol with 7 moles of EO, Neodol 45-7, a $C_{14-15}$ ethoxylated alcohol with 7 moles of EO, Neodol 23-5, a linear $C_{12-13}$ alcohol ethoxylate with 5 moles of EO, HLB of 10.7; Surfonic surfactants, also sold by Huntsman Chemical Company, such as Surfonic L12-6, a $C_{10-12}$ ethoxylated alcohol with 6 moles of EO and L24-7, a $C_{12-14}$ ethoxylated alcohol with 7 moles of EO; and Tergitol surfactants, both sold by Union Carbide, such as Tergitol 25-L-7, a $C_{12-15}$ ethoxylated alcohol with 7 moles of EO. Macol NP-6, an ethoxylated nonylphenol with 6 moles of EO, and an HLB of 10.8, Macol NP-9.5, an ethoxylated nonylphenol with about 11 moles EO and an HLB of 14.2, Macol NP-9.5, an ethoxylated nonylphenol with about 9.5 moles EO and an HLB of 13.0, both from Mazer Chemicals, Inc.; Triton N-101, an ethoxylated nonylphenol with 9–10 moles of ethylene oxide per mole of alcohol ("EO") having a hydrophile-lipophile balance ("HLB") of 13.4, Triton N-111, an ethoxylated nonylphenol with an HLB of 13.8, both from Rohm & Haas Co.; Igepal CO-530, with an HLB of 10.8, Igepal CO-730, with an HLB of 15.0, Igepal CO-720, with an HLB of 14.2, Igepal CO-710, with an HLB of 13.6, Igepal CO-660, with an HLB of 13.2, Igepal CO-620, with an HLB of 12.6, and Igepal CO-610 with an HLB of 12.2, all polyethoxylated nonylphenols from GAF Chemicals Corp.; Alkasurf NP-6, with an HLB of 11.0, Alkasurf NP-15, with an HLB of 15, Alkasurf NP-12, with an HLB of 13.9, Alkasurf NP-11, with an HLB of 13.8, Alkasurf NP-10, with an HLB of 13.5, Alkasurf NP-9, with an HLB of 13.4, and Alkasurf NP-8, with an HLB of 12.0, all polyethoxylated nonylphenols from Alkaril Chemicals; and Surfonic N-60, with an HLB of 10.9, and Surfonic N-120, with an HLB of 14.1, Surfonic N-102, with an HLB of 13.5, Surfonic N-100, with an HLB of 13.3, Surfonic N-95, with an HLB of 12.9, and Surfonic N-85, with an HLB of 12.4, all polyethoxylated nonylphenols from Huntsman. This latter group of nonionic surfactants may classified as either: a) $C_{10-20}$ linear and branched alkoxylated alcohols or b) $C_{10-20}$ alkoxylated alkylphenols. These alkoxylated alcohols include ethoxylated, propoxylated, and ethoxylated and propoxylated $C_{10-20}$ alcohols, with about 1–10 moles of ethylene oxide, or about 1–10 moles of propylene oxide, or 1–10 and 1–10 moles of ethylene oxide and propylene oxide, respectively, per mole of alcohol. Still other preferred surfactants include $C_{10-20}$ alkylether sulfates, such as the Steol line, namely, Steol CS460 and CS230, from Stepan Company. Alkanolamides, such as the Ninol series, 96-SL, are also desirable and also made by Stepan Company.

In place of the nonionic surfactant, it may be possible to use an amphoteric surfactant, such as an alkyl betaine or a sulfobetaine. Especially of interest are the alkylamidoalkyldialkylbetaines. These have the structure:

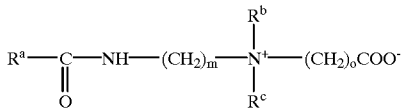

wherein $R^a$ is $C_{6-20}$ alkyl, $R^b$ and $R^c$ are both $C_{1-4}$ alkyl, although $R^b$ and $R^c$ do not have to be equal, and m can be 1–5, preferably 3, and o can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Witco Chemical Co., which offers Rewoteric AMB-15, both of which products are cocobetaines.

b. Anionic Surfactants. The other class of surfactants, which would be used as an auxiliary surfactant, are the anionic surfactants selected from $C_{6-24}$ alkyl sulfates, $C_{6-24}$ alkylbenzene sulfonates, $C_{6-24}$ alkylsulfonates, $C_{6-24}$ secondary alkane sulfonates (paraffin sulfonates), $C_{6-24}$ iseothionates, $C_{6-24}$ alkylethersulfates, $C_{6-24}$ α-olefin sulfonates, $C_{6-24}$ alkyl taurates, $C_{6-24}$ alkyl sarcosinates and the like. Each of these surfactants is generally available as the alkali metal, alkaline earth and ammonium salts thereof. The preferred anionic surfactant is, for example, a linear or branched $C_{6-16}$ alkylbenzene sulfonate, alkane sulfonate, alkyl sulfate, or generally, a sulfated or sulfonated $C_{6-16}$ surfactant. Preferred are the surfactants Pilot L-45, a $C_{11.5}$ alkylbenzene sulfonate (which are referred to as "LAS"), from Pilot Chemical Co., Biosoft S100 and S130 (non-neutralized linear alkylbenzene sulfonic acid, which is referred to as "HLAS") and S40 (neutralized) from Stepan Company. If the anionic surfactant is an acidic HLAS, such as BioSoft S100 or S130, it is neutralized in situ with an alkaline material such as NaOH, KOH, $K_2CO_3$ or $Na_2CO_3$, with more soluble salts being desirable. These acidic surfactants possess a higher actives level and can be cost-effective. Stepanol WAC is an example of a sodium lauryl sulfate (SLS), from Stepan Company.

The amount of each surfactant is generally between about 0.01 to about 10%. On the other hand, when both surfactants are present, the ratio between the nonionic surfactant and the anionic surfactant should preferably be between about 15:1 and 1:15.

2. Borax Pentahydrate

The other, predominant ingredient in this invention is the electrolyte/buffer, borax pentahydrate, or, more properly, di-alkali metal, tetraborate pentahydrate. The alkali metal counterion is most preferably sodium, although lithium and potassium are both possible. Borax pentahydrate in the invention, however, plays the critical role of water soluble abrasive. This is because, although the material is readily soluble in water, in amounts greater than can be solubilized, the added borax material which remains undissolved and suspended, acts as an abrasive for enhanced cleaning performance, especially of stubbornly adhering soils on smooth or glossy hard surfaces.

Borax pentahydrate, as a sodium salt, has the formula $Na_2B_4O_7.5H_2O$ and has properties analogous, but not identical, to borax decahydrate, more commonly known as "ordinary" borax. It is commercially available from North American Chemical Company, as V-Bor®, and U.S. Borax Inc. as Neobor®. The significant difference between the two products is that Neobor® has a larger particle size. In general, however, the preferred borax pentahydrate has a particle size such that the majority passes through a 20 U.S. Mesh sieve (~840$\mu$), but is retained by a 100 U.S. Mesh Sieve (~149$\mu$).

The Unilever patents WO 91/08282 and EP 0 193 375 both disclose the use of preferably sodium bicarbonate as a water soluble abrasive. Among the reasons given, is that bicarbonate does not form a hydrated salt. Further, both references disclose a potential "other" soluble abrasive, but it is sodium borax decahydrate, or "ordinary" borax. Applicants determined that both of the Unilever disclosed abrasives were outperformed by borax pentahydrate in terms of cleaning efficacy. Pentahydrate also lends a desirable opacity to the inventive cleaners, yielding a very white, creamy appearance. Most importantly, however, the use of the pentahydrate resulted in a superior surface safety performance. By "surface safety" is meant the attribute of minimal damage to a glossy or shiny hard surface, such as a plastic tile panel, as measured by reduction of gloss versus an uncleaned panel.

The amount of borax pentahydrate present varies, but is generally an amount which results in at least a partially undissolved part acting as an abrasive portion. This is generally an amount exceeding about 10% by weight, more preferably exceeding about 20% and most preferably exceeding about 25%, of the entire liquid composition. This amount may vary depending on whether an adjunct water soluble abrasive, such as either sodium bicarbonate, or sodium borate decahydrate, is added. The adjunct water soluble abrasive may be present in generally lesser amounts than the borax pentahydrate, although, in fact, it may actually exceed, in certain cases, the borax. However, where both abrasives are co-present, the borax pentahydrate to adjunct abrasive ratio may generally vary from about 50:1 to about 1:5.

3. Water

The other principal ingredient is water, which should be present at a level of at least about 30%, more preferably at least about 35%, and most preferably, at least about 40%. Water forms the predominant, continuous phase in which the other materials are dispersed, except that the water soluble abrasive is only partially dispersed. When the ingredients are combined, a non-Newtonian liquid is apparently formed, in which the viscosity is desirably between about 5,000 to about 20,000 centipoise (cPs), more preferably between about 6,000 and about 15,000 cPs, with a target between about 8,000 and 10,000 cPs. This is measured on a Brookfield RVT with a No. 4 spindle at 5 rpm for two minutes at room temperature (about 21.1° C., 70° F.).

4. Miscellaneous Adjuncts

Small amounts of adjuncts can be added for improving cleaning and/or aesthetic qualities of the invention. Aesthetic adjuncts include fragrances, such as those available from Givaudan-Rohre, International Flavors and Fragrances, Firmenich, Norda, Bush Broke and Allen, Quest and others, and opacifying agents, pigments, dyes and colorants which can be solubilized or suspended in the formulation. A wide variety of opacifiers, pigments, dyes or colorants can be used to impart an aesthetically and commercially pleasing appearance. The amounts of these aesthetic adjuncts should be in the range of 0–2%, more preferably 0–1%. Additionally, because the surfactants in liquid systems are sometimes subject to attack from microorganisms, it is advantageous to add an antimicrobial compound, i.e., a mildewstat or bacteristat. Exemplary compounds include formaldehyde; phenol derivatives; Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boots Company Ltd.; Proxel CRL, a propyl-p-hydroxybenzoate, from ICI PLC; Nipasol M, an o-phenyl-phenol, $Na^+$ salt, from Nipa Laboratories Ltd.; Dowicide A, a 1,2-benzoisothiazolin-3-one, and Dowicil 75, both from Dow Chemical Co.; and Irgasan DP 200, a 2,4,4'-trichloro-2-hydroxydiphenylether, from Ciba-Geigy A.G. See also, Lewis et al., U.S. Pat. No. 4,252,694 and U.S. Pat. No. 4,105,431, incorporated herein by reference. Additionally, it may be desirable to add a viscosity modifier, such as sodium chloride. An additional material is a chelating agent. Preferred is an alkali metal citrate, most preferably, sodium citrate.

In the following Experimental section, the surprising performance benefits of the inventive cleaner are demonstrated.

EXPERIMENTAL

In Table I below, an initial base formulation is disclosed:

TABLE I

Base Formulation A

| Material | Active Wt. % |
|---|---|
| Deionized Water | 58.92 |
| Citric Acid | 1.31 |
| Caustic Soda | 0.81 |
| Borax Pentahydrate[1] | 33 |
| Baking Soda[2] | 1 |
| Na $C_{12}$ LAS[3] | 2 |
| Frgrance[4] | 0.2 |
| Lauryl dimethyl amine oxide[5] | 2.75 |
| Antimicrobial[6] | 0.01 |
| Total | 100 |

[1]Soluble Abrasive; From North American Chemical
[2]$NaHCO_3$ Soluble Abrasive/Buffer; From FMC
[3]From Stepan Company
[4]From Givaudan
[5]From Lonza
[6]From Dow In the following TABLES II–XIV below, both inventive and comparison examples (Formulations B–O) are portrayed. These examples will then be tested as further described below.

TABLE II

Comparison Formulation B

| Material | Active Wt. % |
|---|---|
| Deionized Water | 35.62 |
| NaCl[1] | 8.93 |
| SAS[8] | 1.71 |

TABLE II-continued

| Comparison Formulation B | |
|---|---|
| Material | Active Wt. % |
| AEOS[3] | 3.43 |
| Lauryl Amine Oxide[9] | 0.31 |
| Fragrance[4] | 0.2 |
| Antimicrobial[5] | 0.02 |
| Borax $5H_2O$[6] | 0 |
| $NaHCO_3$[7] | 49.78 |
| Total | 100 |

[1]Viscosity Modifier
[2]Sodium Lauryl Sulfate, from Stepan Company
[3]Alkyl ether sulfate, from Stepan Company
[4]From Givaudan
[5]From Dow
[6]Soluble Abrasive, from North American Chemical
[7]Soluble Abrasive, from Morton (In Formulations C–O, below, these footnotes will not be repeated, although substitute or additional ingredients will be identified.)

TABLE III

| Inventive Formulation C | |
|---|---|
| Material | Active Wt. % |
| Deionized Water | 47.38 |
| NaCl[1] | 8.93 |
| SAS[8] | 1.71 |
| AEOS[3] | 3.43 |
| Lauryl Amine Oxide[9] | 0.32 |
| Fragrance[4] | 0.2 |
| Antimicrobial[5] | 0.01 |
| Borax $5H_2O$[6] | 38.02 |
| $NaHCO_3$[7] | 0 |
| Total | 100 |

[8]Secondary Alkane Sulfonate (Hostapur SAS), Hoechst AG
[9]From Lonza

TABLE IV

| Invention Formulation D | |
|---|---|
| Material | Active Wt. % |
| Deionized Water | 41.5 |
| NaCl[1] | 8.93 |
| SAS[8] | 1.71 |
| AEOS[3] | 3.43 |
| Lauryl Amine Oxide[9] | 0.32 |
| Fragrance[4] | 0.2 |
| Antimicrobial[5] | 0.01 |
| Borax $5H_2O$[6] | 19.01 |
| $NaHCO_3$[7] | 24.89 |
| Total | 100 |

TABLE V

| Comparison Formulation E | |
|---|---|
| Material | Active Wt. % |
| Deionized Water | 50.99 |
| NaCl[1] | 10 |
| $MgCl_2$[10] | 0.09 |
| SLS[2] | 5.09 |

TABLE V-continued

| Comparison Formulation E | |
|---|---|
| Material | Active Wt. % |
| Alkanolamide[11] | 0.91 |
| AEOS[3] | 5.45 |
| Fragrance[4] | 0.18 |
| Antimicrobial[5] | 0.02 |
| Borax $5H_2O$[6] | 0 |
| $NaHCO_3$[7] | 27.27 |
| Total | 100 |

[10]Viscosity Modifier
[11]From Stepan Company

TABLE VI

| Comparison Formulation F | |
|---|---|
| Material | Active Wt. % |
| Deionized Water | 50.74 |
| NaCl[1] | 10 |
| SLS[2] | 5.09 |
| AEOS[3] | 5.46 |
| Fragrance[4] | 0.2 |
| Antimicrobial[5] | 0.01 |
| Borax $5H_2O$[6] | 0 |
| $NaHCO_3$[7] | 28.5 |
| Total | 100 |

TABLE VII

| Invention Formulation G | |
|---|---|
| Material | Active Wt. % |
| Deionized Water | 57.47 |
| NaCl[1] | 10 |
| SLS[2] | 5.09 |
| AEOS[3] | 5.46 |
| Fragrance[4] | 0.2 |
| Antimicrobial[5] | 0.01 |
| Borax $5H_2O$[6] | 21.77 |
| $NaHCO_3$[7] | 0 |
| Total | 100 |

TABLE VIII

| Comparison Formulations H | |
|---|---|
| Material | Active Wt. % |
| Deionized Water | 41.16 |
| Citric Acid | 1.31 |
| NaOH | 0.81 |
| $CaCO_3$[12] | 51.5 |
| LAS[13] | 3 |
| Lauryl dimethyl amine oxide[9] | 2 |
| Fragrance[4] | 0.2 |
| Antimicrobial[5] | 0.02 |
| Borax $5H_2O$[6] | 0 |
| $NaHCO_3$[7] | 0 |
| Total | 100 |

[12]Insoluble abrasive
[13]$C_{12}$ alkylbenzenesulfonate, Stepan Company

TABLE IX

| Inventive Formulation I | |
|---|---|
| Material | Active Wt. % |
| Deionized Water | 53.71 |
| Citric Acid | 1.3 |
| NaOH | 0.98 |
| $CaCO_3$[12] | 0 |
| LAS[13] | 3 |
| Lauryl dimethyl amine oxide[9] | 2 |
| Fragrance[4] | 0.2 |
| Antimicrobial[5] | 0.01 |
| Borax $5H_2O$[6] | 35 |
| $NaHCO_3$[7] | 3.8 |
| Total | 100 |

TABLE X

| Inventive Formulation J | |
|---|---|
| Material | Active Wt. % |
| Deionized Water | 53.46 |
| Citric Acid | 1.31 |
| NaOH | 1.21 |
| $CaCO_3$[12] | 0 |
| LAS[13] | 2.81 |
| Lauryl dimethyl amine oxide[9] | 2 |
| Fragrance[4] | 0.2 |
| Antimicrobial[5] | 0.01 |
| Borax $5H_2O$[6] | 39 |
| $NaHCO_3$[7] | 0 |
| Total | 100 |

TABLE XI

| Inventive Formulation K | |
|---|---|
| Material | Active Wt. % |
| Deionized Water | 56.67 |
| Citric Acid | 1.31 |
| NaOH | 0.81 |
| $CaCO_3$[12] | 0 |
| LAS[13] | 3 |
| Lauryl dimethyl amine oxide[9] | 2 |
| Fragrance[4] | 0.2 |
| Antimicrobial[5] | 0.01 |
| Borax $5H_2O$[6] | 35 |
| $NaHCO_3$[7] | 1 |
| Total | 100 |

TABLE XII

| Inventive Formulation L | |
|---|---|
| Material | Active Wt. % |
| Deionized Water | 55.67 |
| Citric Acid | 1.31 |
| NaOH | 0.81 |
| $CaCO_3$[12] | 0 |
| LAS[13] | 3 |
| Lauryl dimethyl amine oxide[9] | 2 |
| Fragrance[4] | 0.2 |

TABLE XII-continued

| Inventive Formulation L | |
|---|---|
| Material | Active Wt. % |
| Antimicrobial[5] | 0.01 |
| Borax $5H_2O$[6] | 35 |
| $NaHCO_3$[7] | 2 |
| Total | 100 |

TABLE XIII

| Inventive Formulation M | |
|---|---|
| Material | Active Wt. % |
| Deionized Water | 53.67 |
| Citric Acid | 1.31 |
| NaOH | 0.81 |
| $CaCO_3$[12] | 0 |
| LAS[13] | 3 |
| Lauryl dimethyl amine oxide[9] | 2 |
| Fragrance[4] | 0.2 |
| Antimicrobial[5] | 0.01 |
| Borax $5H_2O$[6] | 35 |
| $NaHCO_3$[7] | 4 |
| Total | 100 |

TABLE XIV

| Comparison Formulation N | |
|---|---|
| Material | Active Wt. % |
| Deionized Water | 41 |
| Citric Acid | 1.3 |
| NaOH | 1.17 |
| $CaCO_3$[12] | 51.5 |
| LAS[13] | 2.81 |
| Lauryl dimethyl amine oxide[9] | 2 |
| Fragrance[4] | 0.2 |
| Antimicrobial[5] | 0.02 |
| Borax $5H_2O$[6] | 0 |
| $NaHCO_3$[7] | 0 |
| Total | 100 |

In the next set of examples, surface safety performance and bathroom soil removal performance of the invention and comparison formulations depicted in TABLES II–XIV, above, were observed. The following testing protocols were observed.

SURFACE SAFETY TEST PROTOCOL

In these tests, black, acrylic plastic tiles were treated with liquid cleaning product samples and the amount of gloss remaining was measured. The tiles were mounted onto a Gardner WearTester, whose reciprocating arm contained a sponge loaded with 2.5 ml of the liquid product. The testing arm was reciprocated 25 times (cycles), then the tiles were rinsed and dried. A Pacific Scientific Glossgard II, 20 degree Glossmeter was used to measured the gloss remaining. This was then calculated as:

$$\text{Surface Safety}=(\text{treated gloss}+\text{initial gloss})\times 100\%.$$

The initial gloss is actually measured of an uncleaned tile acting as a standard. In this test, higher scores, or as close to 100%, are desirable.

BATHROOM SOIL REMOVAL I

In this test, again, a Gardner Weartester is used, loaded with 2.5 ml of liquid cleaning product on the sponge-loaded reciprocating arm. However, unlike the Surface Safety Test, above, a different performance is measured. In this case, it is strokes, or cycles, to remove 100% of the bathroom soil (which is a proprietary, fabricated soil) which has been uniformly applied to clean, white tiles. Thus, also unlike the prior test, a lower number, indicating fewer strokes to remove, is better.

BATHROOM SOIL REMOVAL II (MINOLTA TEST)

In this test, bathroom soil removal is measured using, as a testing apparatus, a Minolta proprietary device, which measures the integrated areas under a cleaning profile curve, which is the cumulative amount of soil removed at each cycle, with a maximum of 50 cycles. Thus, a maximum score of 5,000 can theoretically be achieved. In any case, in this test, the higher score achieved is more preferred.

In TABLE XV below, the performance of the inventive cleaners were compared against comparative cleaners, and comparative commercial cleaners with different abrasive systems.

TABLE XV

Surface Safety and Bathroom Soil Removal I

| | Abrasive System | | | Viscosity | | | Bathroom Soil I (Strokes to |
|---|---|---|---|---|---|---|---|
| Cleaner | $CaCO_3$ | Borax $5H_2O$ | $NaHCO_3$ | V initial | V aged | Surface Safety | Remove) |
| Der General | | | 50% | | | 99.9 | 78 |
| Smart Cleanser | | | 28.5 | | | 100 | 50.2 |
| Comparison B | | | 49.78 | 8,520 | 8,240 | 99.7 | 85 |
| Invention C | | 38.02 | | 4,080 | >40,000 | 99.4 | 30.8 |
| Invention D | | 19.01 | 24.89 | 6,200 | 22,280 | 99.5 | 35.2 |
| Comparison E | | | 27.27 | 8,200 | n/a | 100 | 87.8 |
| Comparison F | | | 28.5 | 5,680 | 6,400 | 99.6 | 72.83 |
| Invention G | | 21.77 | | 5,640 | 23,200 | 101.7 | 31 |
| Comparison H | 51.5 | | | 7,080 | 8,760 | 73.6 | 12.4 |
| Invention I | | 35 | 3.8 | 280 | 3,160 | 98.6 | 17.4 |
| Invention J | | 39 | | 320 | 16,400 | 101.4 | 19.4 |
| Invention K | | 35 | 1 | 1,600 | 12,040 | 100.8 | 20 |
| Invention L | | 35 | 2 | 160 | 2,960 | 100.6 | 16.8 |
| Invention M | | 35 | 4 | 240 | 4,880 | 100.8 | 19.2 |
| Comparison N | 51.5 | | | 6,000 | n/a | 73.8 | 12.4 |

From the foregoing, general observations can be made. First, the inventive formulations containing borax pentahydrate had superior surface safety performances, very close to the original values measured by the Glossmeter; the sodium bicarbonate comparison examples also had good surface safety performance. Next, the bathroom soil removal performance (Protocol I, fewer strokes to remove) was very good, in fact, significantly outperformed the bicarbonate comparison examples. Further comparison was made against formulations containing 51.5% $CaCO_3$, an insoluble particulate abrasive. This is a very good abrasive, which is gentler than silica sand. However, even this relatively mild abrasive, while performing very well (as expected) on bathroom soil, performed more poorly on surface safety.

In yet further tests, the soil removal II (Minolta Test) performance and surface safety performance of the invention (roughly analogous to that in Table IV) versus other cleaners was compared:

TABLE XVI

| Product | CaCO3 | Borax Type | BR Soil II (Area) | Surface Safety |
|---|---|---|---|---|
| Soft Scrub | yes | none | 4,239.5 | 46.6 |
| Soft Scrub with Bleach | yes | none | 3,955.4 | 75.3 |
| Smart Cleanser | no | none | 3,915.2 | 98 |
| Comet | yes | none | 3,292.2 | 47.6 |
| Invention | no | Borax $5H_2O$ | 3,432 | 99.6 |
| Comparison | no | Borax $10H_2O$ | 2,138.7 | 96.6 |

Once again, certain observations can be made about the invention. This data especially shows that the Invention achieves significantly superior soil removal performance versus a similar formulation containing borax decahydrate while maintaining its superior surface safety values. The inventive formulation's performance versus other, commercial cleaners is essentially comparable. The levels of borax pentahydrate and decahydrate are adjusted to achieve the same level of equivalent sodium tetraborate regardless of hydration level.

In the final set of data, a comparison is made of the formulation A as set forth in Table I, versus two commercial cleaners, as well as the formulation substituting now borax decahydrate as the water soluble abrasive. The levels of borax pentahydrate and decahydrate are adjusted to achieve the same level of equivalent sodium tetraborate regardless of hydration level.

TABLE XVII

| Formulation | Borax $5H_2O$ | $NaCO_3$ | B.R. Soil II (Area) | Std. Dev. |
|---|---|---|---|---|
| Soft Scrub | 0 | 0 | 3,993.4 | 131.65 |
| Smart Cleanser | 0 | 28.5 | 3,486.7 | 357.36 |
| As in Table I | 33% | | 3,845.5 | 81.7 |
| As in Table I | 43.2% Borax $10H_2O$ | | 3,260.5 | 202.86 |

Once again, the data demonstrates that the inventive cleaner containing borax pentahydrate significantly outperforms an equivalent formulation containing borax decahydrate. This particular result could not have been predicted simply based on the chemistry of the boron compounds and was especially surprising to the applicants.

PREFERRED EMBODIMENT—PROCESS OF MANUFACTURE

The base formulation as set forth in Table I, above, is processed in a preferred manufacturing process as described hereinafter. Instead of the usual order of addition in which all solids are gathered and then slowly admixed with all liquid ingredients, the borax pentahydrate presents a unique situation. In a preferred embodiment of the invention, borax pentahydrate is added at a metered or controlled rate to the top of the reaction vessel, or tank, to prevent borax from clumping and settling. The reaction tank is coupled with a recycle loop which includes a high shear mixer in line. The high shear mixer mixes at an appropriate speed between 0–3,600 rpm, which breaks up the larger particles so that the borax material can go smoothly into suspension. Alternatively, a batch high shear mixer can be used to achieve the same effect. Naturally, because the borax pentahydrate is added in quantities greater than can be solubilized, a portion remains undissolved, forming the soluble abrasive of the invention. This milling in situ of the borax material appears essential for the large scale production of the inventive cleaner. On a smaller scale, the same effect may be achieved by using powdered, or comminuted, borax pentahydrate. Ball mills, rollers, or other means known to those skilled in the art would be logical apparatuses for achieving this comminution.

Turning now to the single drawing figure, this preferred process is further illustrated. A mixing apparatus is generally depicted as 10, consisting of a large vessel or vat 12, which is fitted with an impeller 16 mounted with at least, but not limited to, a single set of blades 18. The vessel 12 is equipped with vanes or baffles 14. Briefly, the vessel is filled with water and the dry ingredients are typically added thereafter, with good stirring provided by the impeller. However, in order to assure smooth processing of the liquid cleaner, a recycle loop, broadly indicated at 100, coupled with a high shear mixer 108—such as high shear mixers produced by Silverson, Ross, Ika or other manufacturers—was connected with the mixing apparatus. The recycle loop consists of conduit 104, with a valve 102, which leads to pump 106, which draws liquid towards high shear mixer 108, then, after mixing the liquid at a speed between 0 to 3,600 rpm, the high shear mixer 108 returns the processed liquid via pipe 110 to opening 112 back into vessel 12, preferably in the direction indicated as A. It has been found especially desirable to cause liquid to flow from vessel 12 into the shear mixer 108 at a fluid speed of at least about 2 meters/sec. This apparently prevents in process settling of the particulate matter and achieves optimal processing of the liquid cleaner.

These and other aspects of the invention are further captured in the claims which follow hereafter.

We claim:

1. An improved surface safe, aqueous, liquid hard surface cleaner consisting essentially of:

a) about 0.1 to about 10% of either a nonionic surfactant, an amphoteric surfactant, or combination of either the nonionic or the amphoteric surfactants with an anionic surfactant;

b) a water soluble borax pentahydrate, the total amount of which exceeds at least 25% of the liquid cleaner, at least a part of which is undissolved, the undissolved part forming an abrasive portion suspended in the liquid cleaner; and c) the remainder, water, which is present at a level of at least 30% of the liquid cleaner.

2. The improved hard surface cleaner of claim 1 further comprising a viscosity modifier and adjunct abrasive.

3. The improved hard surface cleaner of claim 2 wherein said viscosity modifier/adjunct abrasive is an alkali metal bicarbonate.

4. The improved hard surface cleaner of claim 1 further comprising a chelating agent.

5. The improved hard surface cleaner of claim 4 wherein said chelating agent is an alkali metal citrate.

6. The improved hard surface cleaner of claim 1 wherein said component of a) is either a nonionic surfactant selected from amine oxides or an amphoteric surfactant selected from betaines.

7. The improved hard surface cleaner of claim 6 wherein said component of a) is an amine oxide selected from the group consisting of $C_{6-24}$ mono long chain, $C_{1-4}$ di short chain, trialkyl amine oxides, hydroxylated amine oxides, ethoxylated and propoxylated amine oxides, and alkylamidoalkylenedialkylamine oxides.

8. The improved hard surface cleaner of claim 1 wherein said component of a) is a combination of a nonionic and an anionic surfactant.

9. The improved hard surface cleaner of claim 8 wherein the nonionic surfactant is selected from amine oxides and alkoxylated alcohols and alkoxylated alkylphenols, while the anionic surfactant is selected from the group consisting of: $C_{6-24}$ alkyl sulfates, $C_{6-24}$ alkylbenzene sulfonates, $C_{6-24}$ alkylsulfonates, $C_{6-24}$ iseothionates, $C_{6-24}$ secondary alkane sulfonates, $C_{6-24}$ alkylethersulfates, $C_{6-24}$ $\alpha$-olefin sulfonates, $C_{6-24}$ alkyl taurates, $C_{6-24}$ alkyl sarcosinates and mixtures thereof.

10. The improved hard surface cleaner of claim 9 wherein the combination of surfactants is an amine oxide with a $C_{6-24}$ mono long chain alkyl and a $C_{1-4}$ di short chain alkyl and a $C_{6-24}$ alkylbenzene sulfonate.

11. The improved hard surface cleaner of claim 1 further comprising a cleaning and/or aesthetic additive selected from the group consisting of: dyes, opacifying agents, pigments, fragrances, preservatives and mixtures thereof.

12. A method for the essentially non-damaging cleaning of a surface comprising: applying the cleaner of claim 1 to said hard surface.

13. The method of claim 12 wherein said surface is manufactured from manmade materials.

14. A process for manufacturing the improved hard surface cleaner of claim 1, comprising milling borax pentahydrate in situ for incorporation into said improved hard surface cleaner.

15. The process of claim 14 wherein said milling is accomplished by a high shear mixer.

* * * * *